US006851489B2

(12) United States Patent
Hinds

(10) Patent No.: US 6,851,489 B2
(45) Date of Patent: Feb. 8, 2005

(54) METHOD AND APPARATUS FOR DRILLING WELLS

(76) Inventor: Cyril Hinds, Drawer AA, Lafayette, LA (US) 70502

( * ) Notice: Subject to any disclaimer, the term of this patent is extended or adjusted under 35 U.S.C. 154(b) by 0 days.

(21) Appl. No.: 10/059,613

(22) Filed: Jan. 29, 2002

(65) Prior Publication Data

US 2003/0141112 A1 Jul. 31, 2003

(51) Int. Cl.[7] ..... E21B 7/10; E21B 17/16
(52) U.S. Cl. ..... 175/61; 175/325.4; 175/408
(58) Field of Search ..... 175/61, 320, 308, 175/325.1, 325.2, 325.4, 408

(56) References Cited

U.S. PATENT DOCUMENTS 3,062,303 A * 11/1962 Schultz ..... 175/61
3,092,188 A * 6/1963 Farris et al. ..... 175/76
3,141,512 A * 7/1964 Gaskell et al. ..... 175/26
3,298,449 A * 1/1967 Bachman et al. ..... 175/76
3,983,948 A * 10/1976 Jeter ..... 175/45
4,068,730 A * 1/1978 Arnold ..... 175/320
4,168,754 A * 9/1979 Nyholm ..... 175/325.2
4,190,122 A * 2/1980 Arnold ..... 175/320
4,416,339 A * 11/1983 Baker et al. ..... 175/61
4,493,380 A * 1/1985 Townson ..... 175/61
4,699,224 A * 10/1987 Burton ..... 175/61
4,874,045 A * 10/1989 Clayton ..... 175/57

FOREIGN PATENT DOCUMENTS

DE 4225009 A1 * 2/1994 ..... E21B/17/16

* cited by examiner

*Primary Examiner*—David Bagnell
*Assistant Examiner*—Jennifer H Gay
(74) *Attorney, Agent, or Firm*—The Matthews Firm

(57) ABSTRACT

A well borehole is prevented from deviating from its intended vertical path as it is being drilled by use of a sub assembly which is eccentrically weighted with respect to its axis of rotation. Such a sub assembly can comprise a straight tubular member weight relieved along one side by, for example, forming a cavity within the heavy walls of the tubular member along the side of the collar. Thus, the eccentric weight is imposed upon the drill bit without providing any protrusions or elbows which are designed to bear on the wall of the borehole. Additionally, as the cavity is contained within the heavy walls of the tubular member, drilling fluids containing various debris cannot inhabit the cavity, thus maintaining a constant eccentric weight upon the drill bit.

2 Claims, 4 Drawing Sheets

METHOD AND APPARATUS FOR DRILLING WELLS

BACKGROUND OF THE INVENTION

1. Field of the Invention

This invention relates to drill strings employed in well drilling, and more particularity to a method and apparatus for drilling straight wells by preventing unwanted spiraling progressions and slotting effects generally associated with drilling through relatively irregular formations, specifically through extra hard earthen formations.

2. Background of the Invention

Drill string collars generally used in drilling operations consist of long columns of thick walled tubes directly above the drill bit. These collars add additional weight to the drill string pipe to push the rotating drill bit through earthen formations. These drill string collars are generally connected to the thousands of feet of drill string pipe connected thereabove. A rotary drilling rig turns the drill string pipe, which turns the drill collars, which turn the drill bits used in creating a well.

It is well known in the drilling industry that when a drill bit comes into contact with an extra hard earthen formation, especially those formations positioned at an acute angle, the drill bits tend to drift, thus making an elongated hole or slot through the extra hard earthen formation. This drift is caused by the drill bit's attempt to take the path of least resistance as it creates a borehole. Since the drill string pipe which spins to drive the drill bit is not as large in diameter as the drill bit, the slot tends to be larger down-slope than at the first contacted up-slope area of the formation. Thus, when the bit contacts an extra hard earthen formation at an acute angel and drifts, an elongated hole or slot is created which has a much smaller diameter on the up-slope of the formation. This elongated hole or slot causes problems when attempting to withdraw the bit or when running other tools into the well. This dilemma is known in the industry as "key slotting" or "key holing." Once the drill bit has completely penetrated this extra hard formation, the drill bit tends to follow a course consistent with the exiting course of the drill bit as it exits the formation.

In any angled or deviated borehole, there exists a force generated by the pendulum effect of the lower end of the drill string. The earth's own gravitational force exerts a downward pull upon the drill string whereby the drill string reacts to this pull by trying to swing through the lower side of the hole toward a true vertical orientation. The use of heavy drill collars did not have enough force generated by the pendulum effect to overcome the physical and structural forces of the earth's strata which causes the drill bit to deviate. In other words, the force tending to deviate the drill bit is greater than the counter-force tending to return the drill bit to vertical.

Another problem encountered while drilling through extra hard earthen formations is based upon the application of applying weight to a rotating drill string having torque applied thereto. The application of weight forces the drill bit against the formation as it is rotated by the long drive shaft action of the drill string pipe. The drill string pipe is rotatably driven to provide the rotary drilling action of the drill bit. The rotation of the drill string itself, coupled with the biting effect of the rotary drill bit as it contacts a formation as well as the applied weight and torque to the drill bit, tends to bow the drill string pipe and causes the drill bit to take a spiral-like path often referred to as the "corkscrew effect." This corkscrewing of the drill pipe may be quite pronounced in some cases having a spiral several feet in diameter and up to three complete spirals per 100 feet of well depth. Obviously, such spiraling uses more pipe footage and requires more time to drill than would be required with drilling straighter bored wells.

Various types of stabilizers and friction-reducing technologies have been employed to reduce this corkscrew effect, eliminate vibrations and the key slotting problem. Some drilling operators use an adjustable, rotatable sleeve surrounding the main body of the tool which allows the joint to be adjusted to compensate for out of balance conditions. Other stabilizing tools have blades which may be mechanically or hydraulically positioned outwardly relative to the tool body to provide counter balance to the rotating string. In any case, the prior methods' objects are the same, to reduce the amount of wobble, imbalance or vibration in the drill string in an attempt to straighten the drill paths through earthen formations.

A wholly opposite approach has also been applied in the present invention to solve both the key slotting and corkscrewing complications described above. In the 1960's, Cyril Hinds, the inventor of the present invention, modified standard 30 foot to 40 foot long tubulars by boring into one half of the outside surface of the tubular's walls. Essentially, bores were made along one side of the tubulars which created cavities within one half of the surface area of the drill collar. In operation, these tubulars were thought to create an unbalanced condition in the drill string which would compensate for the natural tendency of the drill bit to walk or drift away from the intended drill path. However, these modified tubulars tended to fracture due to the moment created as a result of the unbalanced rotation of the drill string coupled with the weakened tubular wall due to the borings. Thus, the modified tubulars would break off within the well and had to be fished out of the wells creating severe delays and additional expenses.

U.S. Pat. No. 3,391,749 issued to Arnold shows a drill collar which is eccentrically weighted with respect to its longitudinal axis of rotation to prevent deviation from its vertical path by drilling blind holes along a side of the collar. These drill collars tended to break under the stress generated by the high torque pendulum effect.

U.S. Pat. No. 4,068,730 issued to Arnold shows an improved drill collar which is eccentrically weighted to its longitudinal axis of rotation to prevent deviation from its vertical path by drilling blind holes along the side of the collar that vary in size in a cyclical pattern along the length of the collar. These drill collars sought to overcome the weakened conditions associated with U.S. Pat. No. 3,391,749.

U.S. Pat. No. 4,190,122 issued to Arnold shows numerous drill collars which are eccentrically weighted to their respective longitudinal axis of rotation to prevent deviation from its vertical path by drilling blind holes along the side of each collar to prevent the drill collar string's rubbing contact with the sides of the borehole.

U.S. Pat. Nos. 3,391,749; 4,068,730; and 4,190,122 have a common design flaw in common. The blind holes, grooves, slots, etc. disposed on the outer surface of the drill collar as disclosed in each of these patents tend to fill-up with drilling fluids, mud and debris during drilling operations. The material filling-up the various cavities formed on the surface of the drill collar will reduce and/or eliminate the eccentric weight these patents seek to achieve. Therefore, these devices must be continually washed and unclogged to keep their desired eccentric weight to be effective.

U.S. Pat. No. 4,776,436 issued to Nenkov et al. shows a drill collar with an internal 360 degree cavity formed withing the walls of the drill collar filled with articles to dampen and/or absorb shock. Nenkov et al. shows a uniform dispersion of the articles filling the 360 degree cavity with absolutely no off-balance.

U.S. Pat. No. 4,522,271 issued to Bodine et al. shows a similar drill collar with a 360 degree cavity filled with balls, pellets and mud to dampen sonic waves and absorb shock. Bodine et al. also shows a uniform dispersion of the articles filling the 360 degree cavity with absolutely no off-balance.

U.S. patent application Ser. No. 08/999,620, filed by Dewey E. Owens on Mar. 24, 1997, ABANDONED, disclosed a drill collar including a 180 degree cavity within the cross sectional area of the drill collar's walls including a magnetic strip therein and a plurality of steel balls contained within the cavity to provide a counter balancing effect of the drill string pipe while driving a bore hole, whereby the magnetic strip attracts the steel balls to stabilize the drill string and reduce wobble created by any imbalance created by the 180 degree cavity. This invention described in U.S. patent application Ser. No. 08/999,620 was additionally offered for sale on Apr. 16, 1998. The purpose of the invention described in U.S. patent application Ser. No. 08/999,620 was to eliminate the wobble and/or oscillations experienced by drill collars by a counter balancing effect.

The objects, features and advantages of the present invention will become apparent from the drawings and descriptions given herein, and the appended claims.

DETAILED DESCRIPTION OF THE PREFERRED EMBODIMENT

Figure 1:
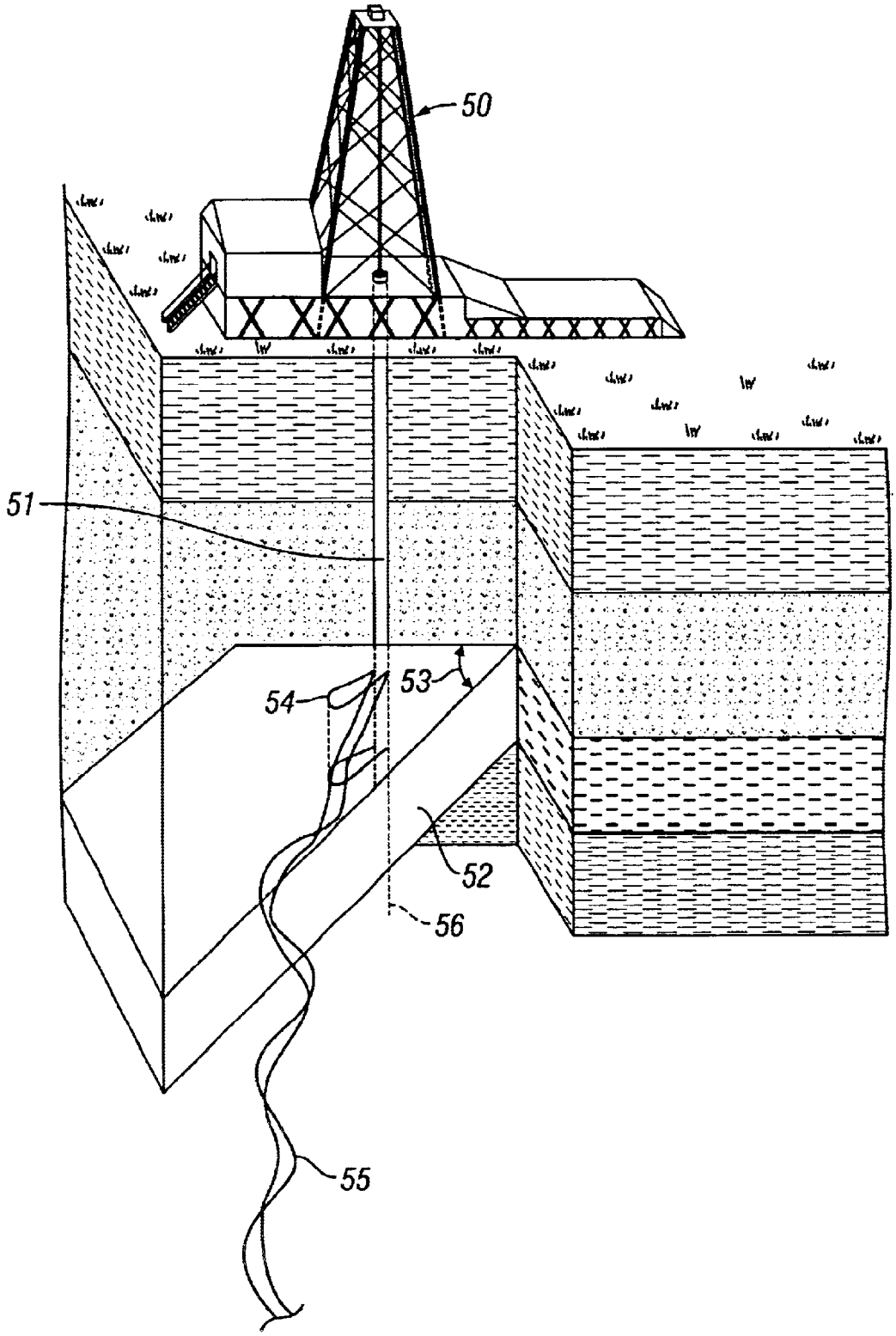
FIG. 1 is a diagram of a typical drilling rig demonstrating problems associated with key holing and corkscrewing.

The complications described above are detailed in FIG. 1. As shown in FIG. 1, a typical drilling rig 50 attempting to drill a substantially vertical well 51. When the drill bit contacts a extra hard earthen formation 52 at an acute angel 53, the bit tends to drift across the surface of the extra hard earthen formation 52 creating an elongated hole 54 often described as the "key slotting" or "key holing" effect. Additionally, as additional weight is applied to the rotating drill string having torque applied thereto to penetrate the extra hard earthen formation 52, the drill bit tends to have a biting effect when it contacts such extra hard earthen formations 52. The rotation of the drill string pipe itself, coupled with the applied weight and torque, tends to bow the drill string pipe and causes the drill bit to take a spiral-like path 55 often referred to as the "corkscrew effect." This spiral-like path 55 of the drill bit results in wasted drill string pipe, time, and extensive costs. The complications such as elongated holes 54 in earthen formations, or key slotting effect, coupled with a spiral-like path 55, or corkscrewing, are overcome by the present invention. As shown in FIG. 1, the intended path 56 of the well has been substantially deviated from due to both key slotting and the corkscrewing effect of the drill bit.

Figure 2:
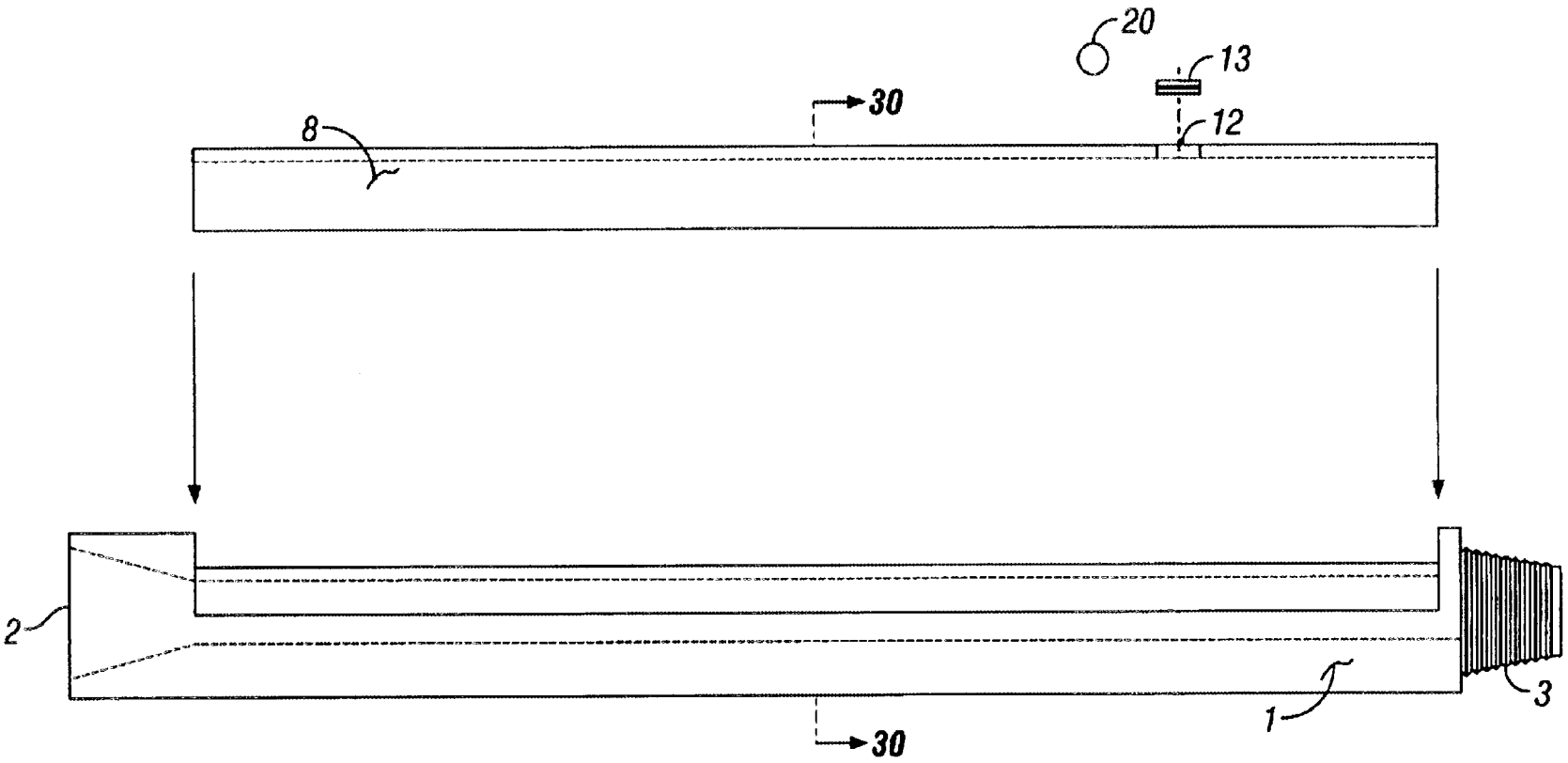
FIG. 2 is a side exploded view of the drill sub assembly.
Figure 3:
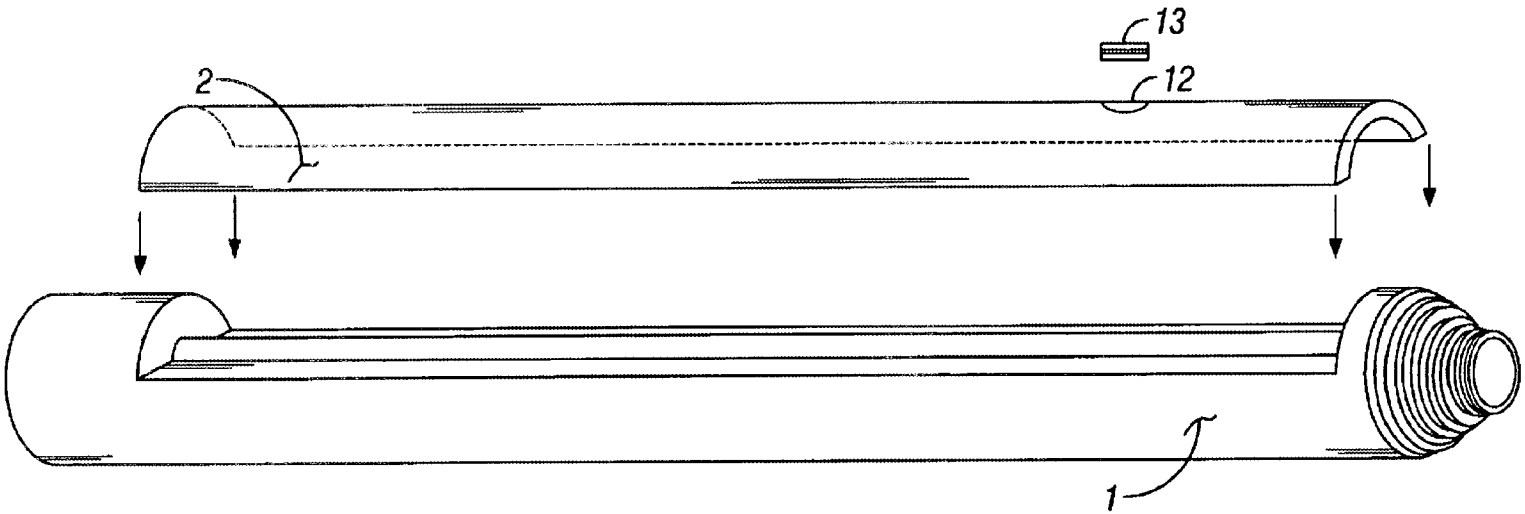
FIG. 3 is an alternate side prospective exploded view of the drill sub assembly.
Figure 4:
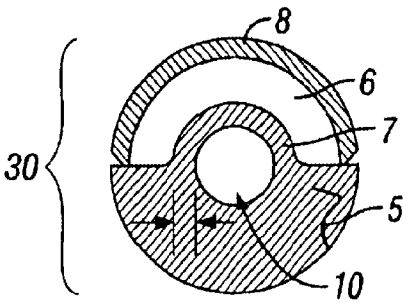
FIG. 4 is a cross section view of the drill sub assembly taken along sight line "30" seen in FIG. 2.

FIG. 2 is a side view of an exploded drill sub assembly 1 of the present invention for a drill for drilling a well, such as an oil well, comprising a top adapter 2 of cylindrical shape, had having an internal thread for interconnecting the sub assembly 1 and a drill collar string (not shown in the drawing). Subs are well known in the art as tubular members that are usually less than the average length of a standard 30 to 40 foot drill string members. The sub assembly 1 also comprises a bottom adapter 3 of cylindrical shape, having an external thread for interconnecting the sub assembly 1 and a drill bit (not shown in the drawing). A drill string pipe (not shown in the drawing) is rotatably driven to provide the rotary drilling action for the drill bit (not shown in the drawings). Interposed between the drill collar string (not shown in the drawing) and the drill bit (not shown in the drawing) is the sub assembly 1 of the present invention. The sub assembly 1 includes a heavy wall body 5 portion having a cavity 6 therein. As seen in FIG. 4, the sub assembly 1 being a typical sub tool joint similar to a heavy wall drill collar which has a internally threaded box end top adapter 2 and an external thread pin end bottom adapter 3. As per FIG. 4, the subassembly combination 30 is substantially a combination of heavy wall body 5 and encasement 8. The cavity 6 is separated from the internal core 10 by a wall 7. The internal core 10 is in fluid communication with the drill bit and through which drilling fluids are pumped fro working up the cuttings and for cooling the drills. The cavity 6 extends approximately the length of the sub assembly 1 between the top adaptor 2 and bottom adaptor 3, formed by exposing a portion of the heavy wall main body 5, leaving only a wall partition 7 surrounding the core 10. A partial encasement 8 having a radius consistent with that of the main body 5 is welded in place as shown in FIG. 4, thereby forming an outer wall for the cavity 6. The cavity 6 thus formed within the heavy wall of the tubular member 5 occupies approximately 180 degrees of the tubular member's wall section.

The 180 degree cavity 6 creates an eccentrically weighted sub assembly which magnifies the pendulum effect to such an extent that the forces tending to cause the drill bit to return to its vertical position are greater than those of the formation tending to cause it to deviate. Thus the eccentrically weighted sub assembly is provided with a heavy side and a light side (the side containing the 180 degree cavity therein). When the drill string rotates about its center during drilling, centrifugal forces are generated. As the drilling sub's heavy side revolves around the center line of the drilling string, the gravitational pendulum effect and the resultant centrifugal force of the heavy side of the collar tend to coincide and are additive. As a result, the drilling sub tends to push the drilling bit with increased force toward the low side of the hole. This action occurs once during each revolution of the drill string and the cumulative affect is to cause the well-bore to return to its original intended vertical position.

It will of course be understood that the cavity 6 may be of any shape, and could be filled with a material heavier than the materials of the sub assembly, such as lead, instead of being left hollow, and the sub assembly may be used with any conventional bits.

In operation, the drill sub assembly 1 is threadably located between the drill collar string and the drill bit. Computer simulations and preliminary testing demonstrate that the drill sub assembly's 1 unbalanced rotation drastically reduces spiraling or corkscrewing by as much as 92% and eliminates key slotting 54. These simulations and preliminary tests indicate that when the drill sub assembly is attached to a drill bit, the drill bit tends to process about the intended drill path 56 while continually oscillating across the intended drill path 56 instead of forming a spiraling revolution around the intended drill path 56. The cavity 6 within the sub assembly 1 creates an unbalanced condition in the drilling string which tends to compensate for the natural tendancy of the drill bit to walk around the intended drill path 56. The sub assembly 1 further provides additional friction in the formation, absorbs shock and vibrations while creating a straight hole due to the sub assembly's imbalance.

In accordance with the present invention, any deviation from the drill bit's intended vertical path is inhibited by imposition on the drill bit a weight which is eccentrically positioned with respect to the axis about which the drill bit is designed to turn. As the top of the drill string is constrained against any horizontal displacement at the rig floor, the effect of the centrifugal force resulting from the eccentrically weighted sub when the string is rotated with the drill string vertical is to urge the drill bit to swing in a circular path, instead of rotating about a fixed point, so that the sides of the bit on which the eccentric weight is positioned is urged against the side of the borehole. This affects all sides of the borehole equally, so long as the borehole is vertical, since the heavy side of the eccentrically weighted sub assembly spends an equal portion of the cycle directed toward each side of the borehole.

However, if and when the drill bit deviates from its intended vertical path so as to be positioned at an angle to the vertical, the weight of the drill bit and sub assembly tend to cause them to gravitate toward the low side of the hole exerting thereagainst a force dependent on the angle between the borehole and the vertical. This is true regardless of whether the sub assembly is eccentrically weighted or not as is a well known phenomenon. Now, when an eccentrically weighted sub assembly of the present invention is utilized, each time the heavy side of the sub assembly is rotated away from the low side of the borehole, the created centrifugal force urges the drill bit and sub assembly towards the heavy side of the eccentrically weighted sub assembly, away from the low side of the borehole, thus subtracting from the force exerted by the weight of the bit. Oppositely, when the heavy side of the eccentrically weighted sub assembly approaches the low side of the borehole, the centrifugal force resulting from the eccentric weight is added to that resulting from the weight of the bit. The result is an intermittent pounding force which acts preferentially against the low side of the hole only, since the weight of the eccentrically weighted sub assembly and drill bit always adds to the pressure against the low side of the borehole but is subtracted from that against the high side of the borehole. It is believed that this pounding tends to abrade away the low side of, and thus straighten, the borehole.

A threaded aperture 12 is provided in the cavity's 6 encasement 8 for allowing insertion or removal of an optional steel ball 20 approximately 1 to 2 inches in diameter and plugged with a bung plug 13, the plug having a square socket therein. The internal core 10 is in fluid communication with the drill bit and through which drilling fluids are pumped fro working up the cuttings and for cooling the drills. The drilling fluids are often very abrasive and tend to degrade the wall partition 7 between the internal core 10 and the cavity 6. When the wall partition 7 has been compromised, drilling fluid will fill the cavity and will diminish the off-balanced object of the present invention. Thus, an optional steel ball 20 may be inserted into the cavity 6 via the threaded aperture 12 to alarm rig operators when the wall partition 7 has been compromised. The rig operators must periodically pull the drilling tools out of the well for routine maintenance and cleaning. The operators can easily determine if the wall partition 7 has been compromised by moving the utility sub 1 of the present invention and listening for the steel ball 20 to rattle around. If the wall partition 7 has been compromised and the cavity 6 contains any drilling fluids, the steel ball 20 will be restricted in its movement within the cavity 6.

Figure 5:
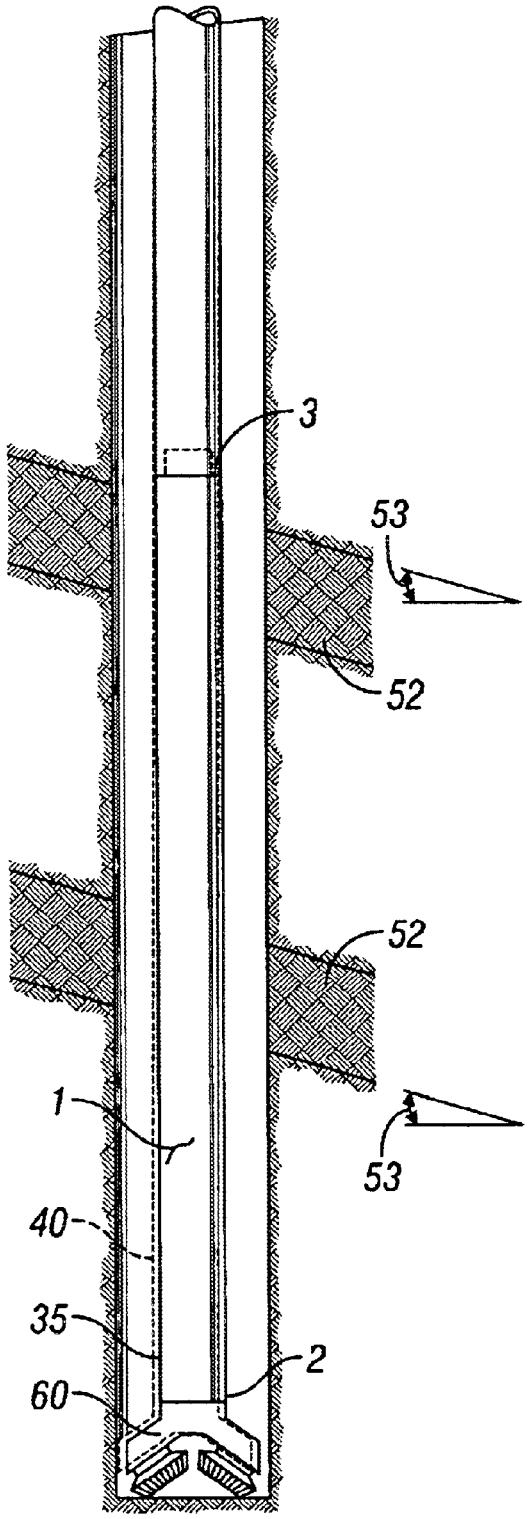
FIG. 5 is a vertical section showing a bit surmounted the sub assembly of the present invention at work in a well, the deviation of which form the vertical has been exagerated to make it more clearly apparent.

Now referring to FIG. 5, it will be seen that a conventional drill bit 20, e.g., a three-cone rock bit, is mounted at the bottom of a string of pipe. Immediately above the bit 20 is the sub assembly 1 of the present invention. The outer surface of the sub assembly 1 is preferably, but not necessarily, concentric with or symmetrical with respect to its longitudinal axis. One side of the sub assembly 1 is, however, heavier than the other so that as the drill string rotates the sub assembly 1 will tend to revolve or gyrate about the longitudinal axis of the string. It is, however, neither necessary nor desirable for the sub assembly 1 itself to swing far enough out of line to brush against the wall of the well.

As the sub assembly 1 revolves about its longitudinal axis the bit 20 swings from its solid line position 35 against the low side of the hole to its dotted line position 40 toward the high side once every rotation. (This distance has likewise been exaggerated in the figure so that it may be clearly seen.) As hereinbefore pointed out, every time the heavy side of the collar approaches the low side of the hole, a force representing a component of the total weight of the sub assembly 1 and bit is added to the centrifugal force due to the extra weight on the heavy side of the sub assembly 1 to produce an abrasive pounding of the low side of the hole, but the effect of this component of the total weight is subtracted from that of centrifugal force as the heavy side of the sub assembly 1 approaches its dotted line position 40, so that there is much less force exerted against the high side of the hole.

To further reduce the complications associated with key slotting and the corkscrew effect, the drilling rig operator should recognize when the drill bit strikes an extra hard earthen formation. After the drill bit strikes an extra hard earthen formation, the operator should lift the drill bit away from the surface of the earthen formation and increase the rotations-per-minute (rpm) of the bit. Once the rpms have increased, the operator then lowers the drill bit against the extra hard earthen formation until the oscillating bit cuts away the uphill slope of the formation. This process is repeated until the drill bit has formed a shoulder on the surface of the extra hardened formation. This shoulder will ensure the drill will continue along its original course and reduce the possibility of key slotting or the corkscrew effect. The drilling rig operators repeated raising and lowering of the drill bit is often referred to as yo-yo'ing the drill bit. This technique quickly creates an intended path for the drill bit through the extra hard earthen formation.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention.

What is claimed is:

1. The method of inhibiting deviation from vertical in drilling a borehole with a rotating bit on a drill string comprising:

placing in the drilling string above the bit an eccentrically weighed sub assembly, wherein said eccentrically weighed sub is created by at least one enclosed cavity contained within the wall of the sub assembly, said cavity positioned with respect to the axis of rotation of the bit: and rotating the bit while avoiding preferential bearing of any portion of the drill string against the wall of the borehole in the region of said eccentric weight;

wherein the method further includes recognizing that the cavity of the sub assembly has not been breached whereby at least one steel ball is contained within the eccentrically positioned cavity with freedom of motion therein, and wherein the ball provides an accoustical inflection when it contacts the inner wall of the cavity is unbreached.

2. The method of claim 1 wherein at least one threaded aperture is made extending from the outer wall of the sub assembly into the cavity and a threaded plug for insertion in the aperture and wherein at least one steel ball is inserted and removed the aperture.

* * * * *